United States Patent [19]

Grow et al.

[11] Patent Number: 4,627,264

[45] Date of Patent: Dec. 9, 1986

[54] CAM ACTUATED EJECTOR FOR A SHELL PRESS

[75] Inventors: Arthur L. Grow, Versailles; Charles J. Gregorovich, St. Marys; Donald N. Seyfried, New Bremen, all of Ohio

[73] Assignee: The Minster Machine Company, Minster, Ohio

[21] Appl. No.: 696,713

[22] Filed: Jan. 31, 1985

Related U.S. Application Data

[62] Division of Ser. No. 455,000, Jan. 3, 1983, Pat. No. 4,513,600.

[51] Int. Cl.[4] ..... B21D 22/00

[52] U.S. Cl. ..... 72/345; 72/347; 72/427

[58] Field of Search ..... 10/11 R, 11 A, ; 72/344–346, 427, 405, 352, 347

[56] References Cited

U.S. PATENT DOCUMENTS

| | | | |
|---|---|---|---|
| 2,330,554 | 9/1943 | Cameron . | |
| 2,579,940 | 8/1946 | Lobrovich . | |
| 2,960,949 | 9/1958 | Smith et al. . | |
| 3,293,414 | 8/1962 | Barcia . | |
| 3,452,582 | 1/1967 | Faymonville . | |
| 3,500,521 | 3/1971 | Byam et al. | 10/11 R |
| 3,645,581 | 2/1972 | Lasch, Jr. et al. . | |
| 3,812,947 | 5/1974 | Nygaard . | |
| 3,874,740 | 4/1975 | Hurd . | |
| 3,941,070 | 3/1976 | Kaminski . | |
| 3,953,076 | 4/1976 | Hurd . | |
| 3,975,057 | 8/1976 | Hurd . | |
| 4,250,730 | 2/1981 | Richner . | |
| 4,296,625 | 10/1981 | Weller et al. . | |

FOREIGN PATENT DOCUMENTS

| | | |
|---|---|---|
| 2161938 | 6/1973 | Fed. Rep. of Germany . |
| 2414494 | 10/1975 | Fed. Rep. of Germany . |
| 3203787 | 10/1982 | Fed. Rep. of Germany . |

*Primary Examiner*—Leon Gilden

*Attorney, Agent, or Firm*—Albert L. Jeffers; Anthony Niewyk

[57] ABSTRACT

A cam actuated ejector is provided with a shell press having a crankshaft for reciprocating a slide to which die tooling is mounted and having a forming station in which the die tooling forms a part to be ejected. The ejector includes a kicker bar slidably received within a recess in the press and which is in close proximity to and substantially coplanar with a part to be ejected. The kicker bar is positively reciprocated by a cam assembly that is synchronously engaged with the crankshaft, which operates the press slide, such that an end of the kicker bar cyclically moves at a first rate of movement from a first position outside the forming station to an intermediate position wherein the end contacts a part to be ejected. The cam assembly continues to advance the kicker bar at a second rate of movement greater than the first rate from the intermediate position to a second position to eject the part and thereafter the cam assembly rapidly withdraws the kicker bar end from the second position to the first position to clear the die area and to ready it for subsequent cyclic ejection of other formed parts. The different timed rates of movement of the kicker bar are provided by selectively contouring the cam surfaces within the cam assembly to contact the part at an optimum speed and to provide positive drive to the kicker bar throughout its cyclic movements.

10 Claims, 9 Drawing Figures

CAM ACTUATED EJECTOR FOR A SHELL PRESS

This is a division of application Ser. No. 455,000, filed 1/3/83, U.S. Pat. No. 4,513,600.

BACKGROUND OF THE INVENTION

1. Field of the Invention

This invention relates to a press, such as a shell press for manufacturing can ends for beverage and like cans, and more particularly to a cam actuated ejector mechanism for ejecting formed parts from a press.

2. Description of the Prior Art

The shell press with which the present invention can be used forms shells, which are the ends of beverage or food cans, that are later seamed to can bodies. The shells are formed from wide strips of steel, aluminum, or other suitable material and may be formed in groups of ten, twelve, etc. When formed in such groups, for example ten at a time, two rows of five shells will be formed from the width of material, and the rows will be disposed so that the shells of one row will be staggered in relation to the shells of an adjacent row in order to minimize skeleton material, i.e., the material left after the parts are blanked out.

There are principally two types of ejectors for shells of which the applicant is aware. In the first type, the ejector is mounted on the shell press and includes a plurality of arms that inwardly swing underneath the slide to eject the shell after it has been formed. The arms' forward or extending motion is spring actuated, while their rearward or retracting motion is mechanically actuated. When the shells are positioned for ejection, the kicker arms are mechanically released and accelerated by spring action into the forming area to eject the shells onto tracks that are downwardly inclined to deliver the shells to a conveyor for conveyance to subsequent stations.

There are a number of disadvantages associated with the above ejector which undesirably affect the production of shells. Firstly, since the ejector arms are spring actuated, they quickly accelerate to a high speed before engaging the shells, and, upon striking the shells, often deform some of the shells due to the large force with which they are struck. When this occurs, the shells are unsuitable for seaming with can bodies and must be discarded and replaced. Secondly, because the ejector arms move in an arcing manner into and out of the slide area, the press slide may not be closed to form the next shell until the last ejector arm has cleared its path. Further, because the shells are formed in a staggered manner to minimize the skeleton, certain of the shells are more inwardly disposed in the slide area, thereby necessitating that their ejector arms be longer than adjacent ejector arms. Therefore, it follows that these longer arms will have much longer strokes into and out of the slide area, greater masses, and require more clearance and time to be withdrawn out of the slide area, which slows the production of shells by the press.

Thirdly, and related to the spring actuation of the ejector arms, the forward or extending movement of the ejector arms is purely a function of spring tension and is independent of the speed of the press. Such spring actuation does not permit desirable and efficient synchronous motion of the ejector with the press.

Fourthly, since the ejector arms move independently of the press, they cannot be optimally released until adequate clearance is provided in the forming area. This necessitates the precautionary step of not releasing the ejector arms until sufficient clearance is available, thereby creating undesirable dead time between the release of the ejector arm and ejection of the shell.

Fifthly, all springs experience fatigue after a certain number of cycles resulting in progressively weaker spring forces to accelerate the released ejector arms. At a certain point in time, the springs may not possess sufficient force to properly eject shells, and should the operator tighten the spring to maintain the required spring force, failure of the spring will only be accelerated since it will now no longer be operating within its proper range of deformation.

In the second type of ejector with which the applicant is familiar, a plurality of rods or bars reciprocate within a plane underneath the slide of the press to eject the shells. The rods or bars are so disposed relative to the slide that they eject half of the shells in one direction and the other half in the opposite direction. Like the first ejector mechanism, this second type also utilizes spring force to release the rods or bars, which are then retracted by a mechanical device, for example a cam. Consequently, this latter ejector has undesirable characteristics of the former, for example, deformation of some of the shells due to the large force with which they are struck by the spring actuated rods or bars, forward movement of the rod or bars independent of the speed of the press, and progressive fatigue and eventual failure of the springs.

SUMMARY OF THE INVENTION

The present invention eliminates the above-described disadvantages of the prior art by providing an ejector device having ejector arms that are positively reciprocated by a cam assembly throughout their forward or extending movement and their rearward or retracting movement.

By providing positive reciprocation with a cam assembly, the present invention allows the rate of movement of the ejector arms to be selectively controlled by providing the proper contour to the cam surfaces. Properly contoured cam surfaces accelerate the ejector arms more slowly to a position where they contact the shells to be ejected, thereafter rapidly accelerate the arms to eject the shells and then retract the arms from the slide area. This minimizes the impact against the edges of the shells, thereby preventing their deformation, and also allows the shell press to be operated at optimum speed.

The present invention also provides for the reciprocating ejector arms and the shells to be ejected to be substantially coplanar with each other. This permits the ejector arms to have shorter, similar stroke lengths since they move linearly and not in an arcing manner, thereby minimizing space requirements for the press.

Synchronized movement of the ejector arms with the operation of the press permits the position of the ejector arms relative to the slide to be known. This advantageously permits quick ejection of the shells because the ejector arms may be precisely timed to enter the slide area when proper clearance is provided.

Furthermore, by eliminating the use of springs in the ejector mechanism, the present invention eliminates fatigue and failure problems associated with springs, and provides a quieter operating cam actuated ejector.

Although the invention is shown mounted on a shell press, it could be used with other types of presses.

In the broader aspects of this invention, there is provided in a press including a crankshaft for reciprocating a slide containing tooling and having a forming station in which the tooling forms a part, a part ejector mechanism for ejecting the part from the forming station. The ejector mechanism comprises an ejector arm movable between a first position wherein an end of the ejector arm is located outside the forming station and spaced from the shell to be ejected and a second position wherein the ejector arm end is disposed in the forming station in the space previously occupied by the ejected shell. A device for cyclically moving the ejector arm from the first to the second position and from the second to the first position comprises a cam element having a contoured cam surface and a cam follower in engagement with the cam surface. Either the cam element or cam follower is operatively connected to the ejector arm, and the other of the cam element and cam follower is connected to a device synchronized with the press crankshaft to cause relative movement between the cam surface and the cam follower. The relative movement positively reciprocates the ejector arm from the first to the second position and from the second to the first position.

It is an oject of the present invention to provide a cam actuated ejector for a press, such as a shell press.

Another object of the present invention is to provide a cam actuated ejector wherein the reciprocating movements of the ejector arms are selectively synchronized with the movement of the press slide.

Still another object of the present invention is to provide a cam actuated ejector for a press wherein the reciprocating arms may be more slowly accelerated to a position in contact with the parts to be ejected, and thereafter rapidly accelerated to eject the parts and to be withdrawn from the die area.

A further object of the present invention is to provide a cam actuated ejector for a press wherein the reciprocating ejector arms and parts are substantially coplanar, thereby providing shorter, similar ejector arm stroke lengths to minimize space requirements of the press.

A still further object of the present invention is to provide a cam actuated ejector for a press which operates quieter than spring actuated ejector devices.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1A:
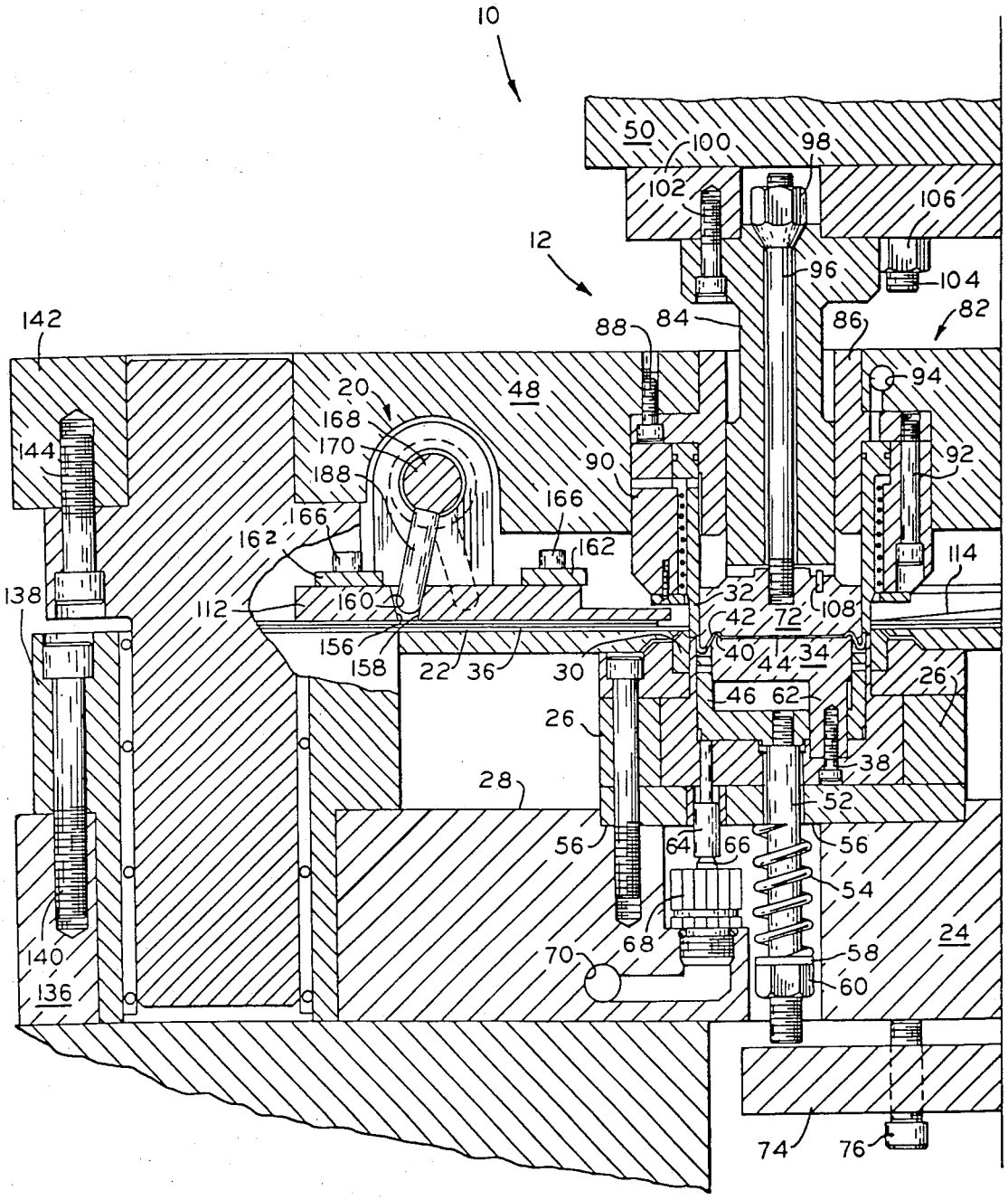
FIG. 1A is a partially broken away and partially sectioned front elevational view of a shell press incorporating an embodiment of the present invention.
Figure 1B:
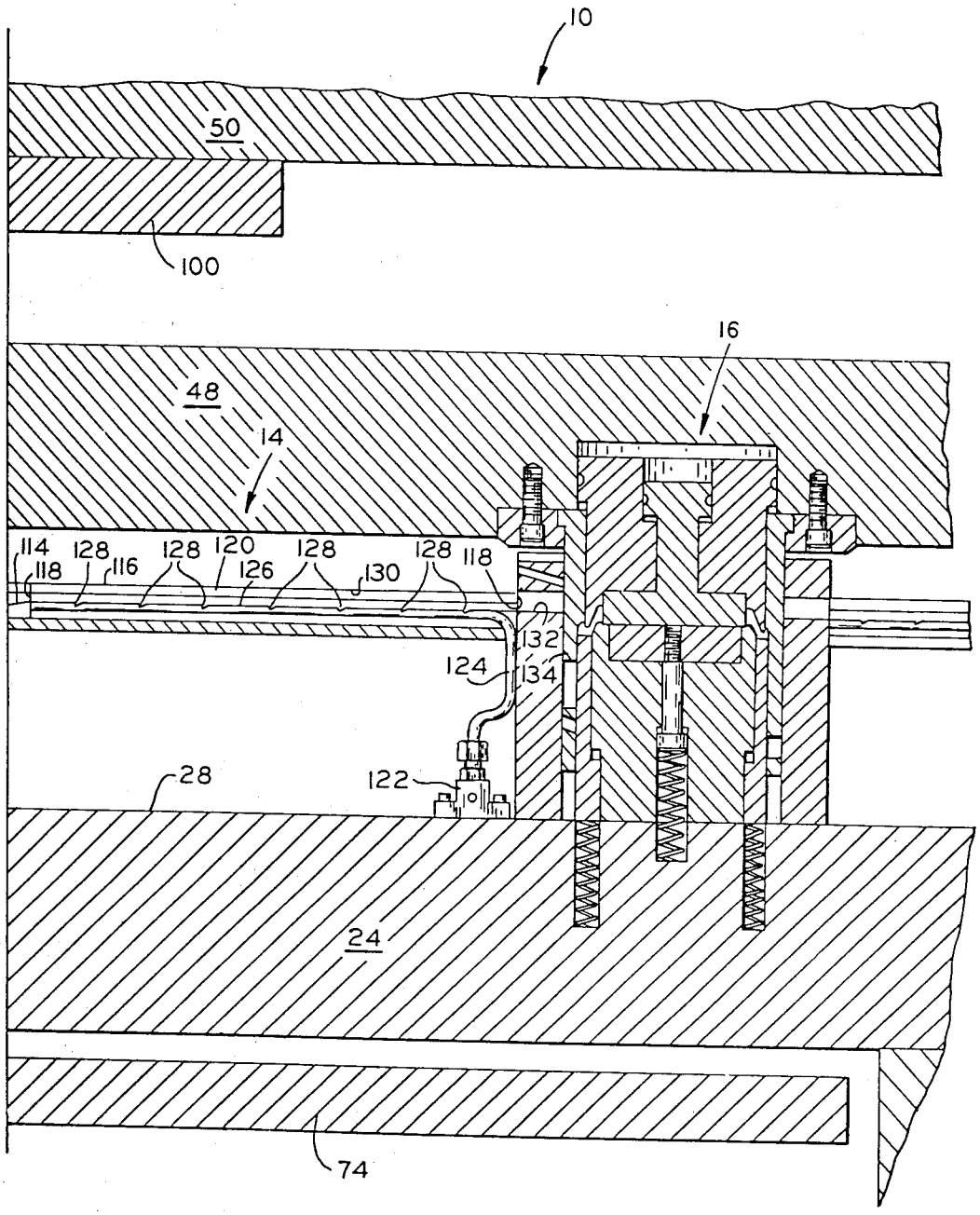
FIG. 1B is an extension of the righthand side of FIG. 1A.

Referring now to FIGS. 1A, 1B, the relevant portion of shell press 10 is illustrated comprising blanking and forming punch assembly 12, air conveyor assembly 14, curling punch assembly 16, and the incorporated invention, cam actuated ejector 20. Not shown is a strip stock feeder that feeds strip stock 22 to press 10 and a scrap cutter for cutting the skeleton of strip stock 22.

Referring now to FIGS. 1A, 1B, 2 and 3, blanking and forming punch assembly 12 will be described. Stationary bolster 24 is secured to the press bed (not shown) and cutting die retainer assembly 26 is secured on the upper surface 28 thereof. Annular cutting die 30 is received within and secured to cutting die retainer assembly 26 and cooperates with punch 32 to stamp out a circular blank when punch 32 is driven downwardly, as will be described below.

Lower forming die 34, the cross section of which is circular in a plane parallel to tin line 36, is connected to cutting die retainer assembly 26 by screws 38. Thus, cutting die retainer assembly 26, lower forming die 34, and bolster 24 are rigidly connected to the press frame. Lower forming die 34 includes an annular bead portion 40 (FIG. 4), which forms a correspondingly shaped bead portion 42 in the finished shell 44.

Lift out element 46 is slidably received within cutting die retainer group 26 for reciprocating movement in the same direction as the direction of movement of blanking slide 48 and forming slide 50. Lift out element 46 is yieldably pulled downwardly by means of lift-out stem 52 which is threadedly secured to lift-out element 46 and compression spring 54, which is disposed between the lower surface 56 of cutting die retainer assembly 26 and washer 58 held in place by nut 60. The holding force developed by spring 54 can be adjusted by means of nut 60, and lift-out element 46 slides around the lower portion 62 of lower forming die 34.

Lift-out element 46 is pushed to its intermediate position by means of lift-out pins 64, which are slidably received in cutting die retainer assembly 26. Lift-out pins 64 are pressed upwardly by stems 66, which are connected to pistons (not shown) within pressure cylinders 68, the latter being threadedly secured to bolster 24 and sealed thereagainst. A fluid passage 70 is connected to a source of pressurized air to yieldably lift the part against the action of upper forming die 72. It will be noted that lift-out pins 64 engage lift-out element 46 so as to raise lift-out element 46 against the action of spring 54. Stems 52 are lifted by lift-out plate 74, which slides over screws 76 connected to bolster 24. FIG. 1A illustrates lift-out plate 74 in its fully retracted position.

Parenthetically, blanking slide 48 is slidably received on posts 78 (FIG. 3) and forming slide 50 is slidably guided in slide 48. Slides 48, 50 are driven by the connecting rods (not shown) and crankshaft 80 (FIG. 2) operated by an electric motor (not shown).

Turning now to the upper dies of shell press 10, housing assembly 82 is slidably disposed with respect to spindle 84, and retains punch 32 for slidable movement relative thereto. Housing assembly 82 comprises spindle alignment bearing 86 connected to blanking slide 48 by screws 88, and guide bushing 90 connected to spindle alignment bearing 86 by screws 92. Air pressure from air passage 94 yieldably and continously urges punch 32 downwardly toward annular cutting die 30.

Figure 4:
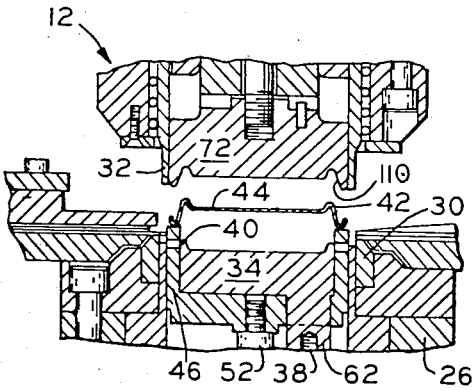
FIG. 4 is an enlarged, fragmentary, sectional view of the shell press illustrating the position of the blanking and forming punch assembly after a shell has been formed.

Referring to FIGS. 1A, 1B and 4, upper forming die 72 is rigidly connected to spindle 84 by retaining rod 96, which is threadedly secured at its lower end to forming die 72 and is held against spindle 84 at its upper end by nut 98. Spindle 84 is connected to top plate 100 by screws 102, and top plate 100 is connected to forming slide 50 by bolts 104 and nuts 106. Dowel 108 prevents rotation between forming die 50 and spindle 84. It will be noted that forming die 72 comprises an annular bead portion 110 around its periphery.

During operation of shell press 10, blanking slide 48 and forming slide 50 are driven downwardly by a crankshaft 80 with punch 32 leading upper forming die 72. Prior to this, the strip stock feed has fed a portion of strip stock 22 within the forming area, and upon further downward movement of blanking and forming slides 48, 50, respectively, a circular blank is cut and formed into shell 44. Thereafter, crankshaft 80 moves slides 48, 50 upwardly with upper forming die 72 leading punch 32. At a predetermined point in the cycle, upper forming die 72 is withdrawn from shell 44, while punch 32 remains in contact therewith. At this time, lift-out element 46 begins to move upwardly to elevate shell 44 to a position as indicated in FIG. 4, and at this point punch 32 moves upwardly away from shell 44 as indicated in FIG. 4. Once shell 44 is formed and is positioned as indicated in FIG. 4 during the press cycle, ejector bar 112 of cam actuated ejector 20 is moved to a position wherein it contacts shell 44 and thereafter is more rapidly accelerated to eject shell 44 from blanking and forming punch assembly 12 upwardly along incline 114 to air conveyor assembly 14. The description and operation of cam actuated ejector 20 is given below, while a more detailed description and operation of shell press 10 may be found in U.S. patent application Ser. No. 165,966, filed July 7, 1980, which has been assigned to the assignee of the present invention.

Referring to FIGS. 1A, 1B, air conveyor assembly 14 comprises channel 116 horizontally disposed between incline 114 and curling punch assembly 16 and has channel opening 118 and sides 120 extending the length thereof. A source of pressure air is delivered through connector 122 to air passage 124 which is disposed underneath lower surface 126 of channel 116. Air passage 124 has a plurality of slots 128 angularly cut therein and which direct the pressure air into channel 116 in a direction toward the upper righthand corner of FIG. 1B. As shells 44 are ejected by cam actuated ejector 20 along incline 114, they are forcibly lifted and moved along upper surface 130 of channel 116 toward curling punch assembly 16 by pressure air exiting slots 128. Shells 44 are then air conveyed to opening 132 and held there by respective outer curling die 134 of curling punch assembly 16.

Figure 3:
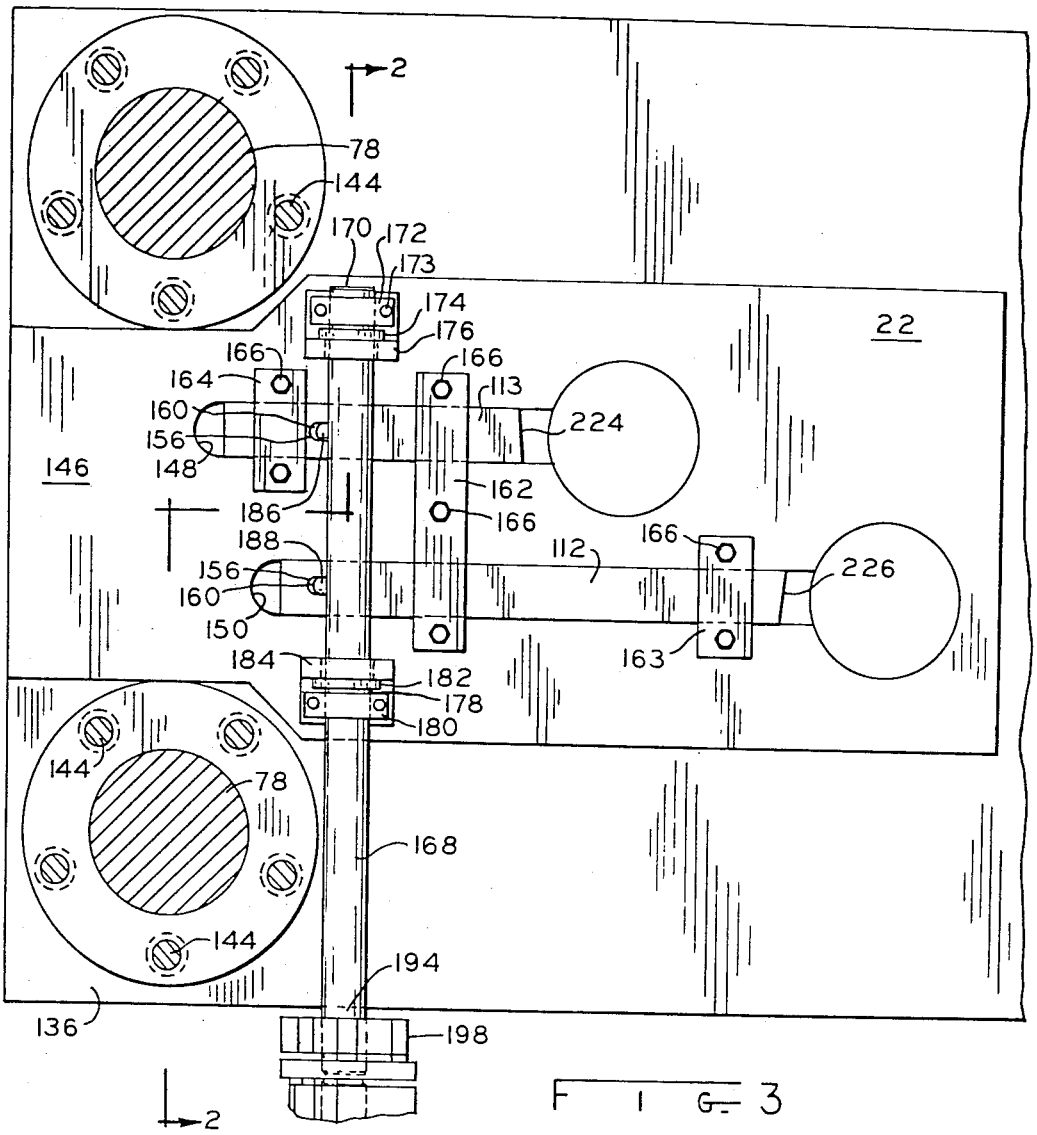
FIG. 3 is a cut-away top plan view of the operating shaft and ejector arms of an embodiment of the present invention.

The following description of cam actuated ejector 20 will include only two ejector bars 112, 113 for ejecting two formed shells 44, which are shown in staggered relation on strip stock 22 in FIG. 3. However, the following description will enable one skilled in the art to construct cam actuated ejector 20 with a plurality of ejector bars 112, 113.

Figure 2:
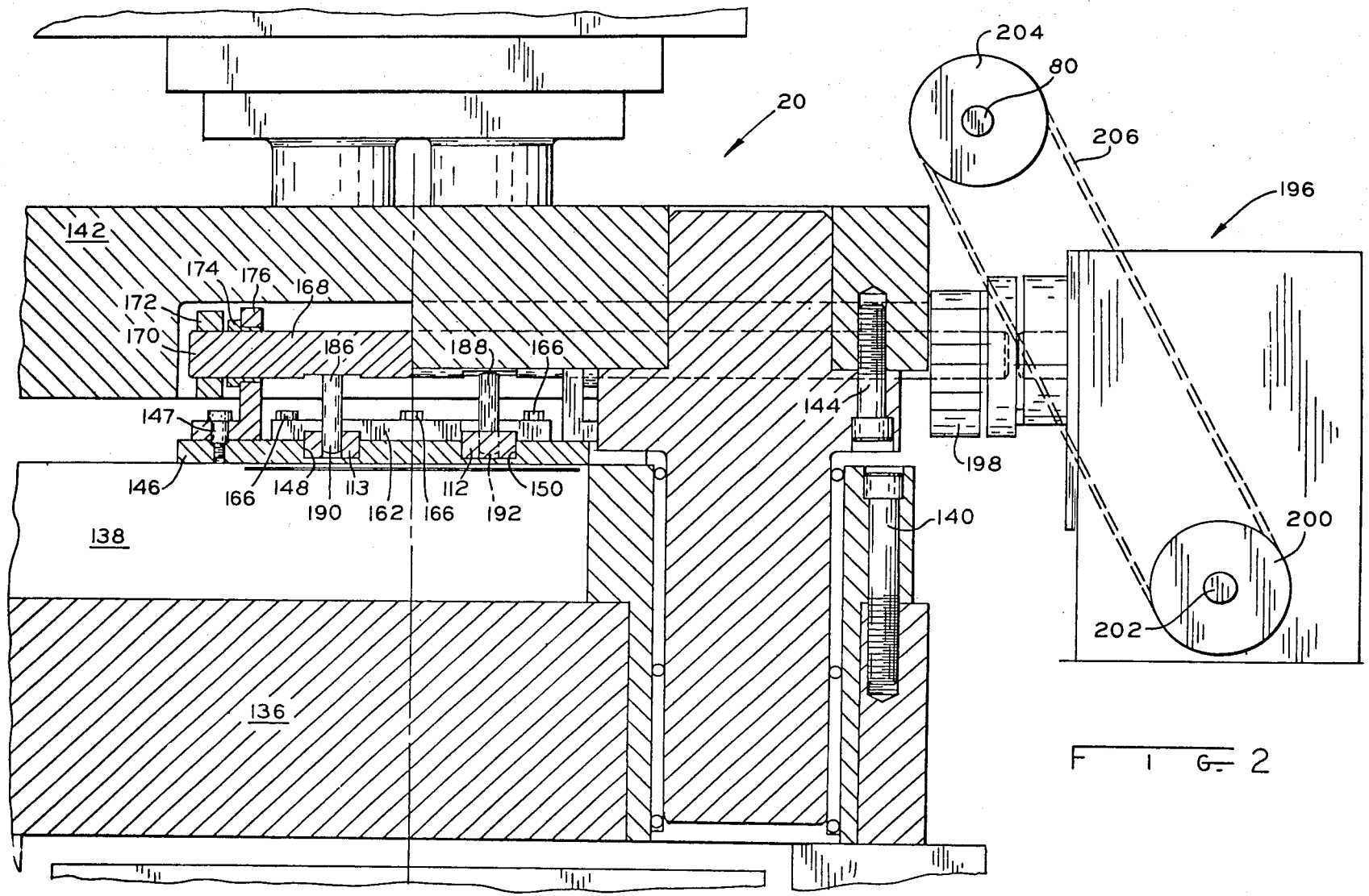
FIG. 2 is a partially broken away and partially sectioned side elevational view of FIG. 1A.

Referring to FIGS. 1A, 1B, 2, 3, and particularly FIG. 2, lower die assembly 136, of which blanking and forming punch assembly 12 is a part, has bottom platform 138 secured thereto by screws 140 and top platform 142 secured thereto by screws 144 such that platforms 138, 142 are spaced apart a predetermined distance for receiving a portion of cam actuated ejector 20. Plate 146 is secured to bottom platform 138 by screws 147, and has recess 148 and recess 150 disposed therein for slidably receiving therein ejector bar 113, ejector bar 112, respectively. Each ejector bar 112, 113 has a respective slot 156 disposed therein, which has front wall 158 and back wall 160 angularly disposed relative one to the other so that, walls 158, 160 form an angle of approximately sixty degrees (60°) therebetween for purposes hereinafter disclosed (FIG. 3). Ejector bars 113, 112 are held in recesses 148, 150, respectively, by bracket 162, 163, 164, which are secured to plate 146 by screws 166.

Continuing to refer to FIGS. 1A, 1B, 2, 3, operating shaft 168 is horizontally disposed above slots 156 and has its distal end 170 supported by bearing 172 secured to lower die assembly 136 by screws 173 and bushing 174, which is supported by shaft guide 176 secured to plate 146 by screws 147. Midportion 178 of operating shaft 168 is likewise supported by bearing 180 and bushing 182 in shaft guide 184, thereby permitting operating shaft 168 to rotate and/or oscillate about its longitudinal axis. Ejector bars 113, 112 are engaged with operating shaft 168 by operating arms 186, 188. Each arm 186, 188 is secured to operating shaft 168 to rotate or oscillate therewith, and have their respective remote ends 190, 192 received within slots 156 of ejector bars 113, 112, respectively. Because remote ends 186, 188 are arcuately shaped and walls 158, 160 of slots 156 are angularly disposed, the operative engagement between operating arms 186, 188 and ejector bars 113, 112 is more easily accomplished.

In FIGS. 2 and 3, opposite end 194 of operating shaft 168 is coupled to cam assembly 196 by a suitable coupler 198, such as a Schmidt coupling. Coupling 198 compensates for any misalignment between operating shaft 168 and cam assembly 196. Cam assembly 196 is engaged with press crankshaft extension 80 by sprocket 200, which is secured to input shaft 202 of cam assembly 196, and sprocket 204, which is secured to crankshaft 80, and chain 206, which engages sprockets 200, 204.

Figures 5A, 5B, 5C:
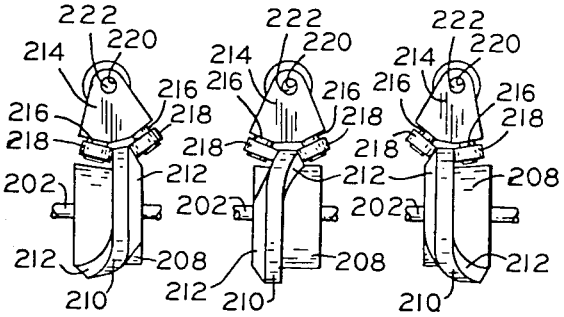
FIG. 5A is a front elevational view of a cam device of an embodiment of the present invention depicting the cam follower in a first extreme position.
FIG. 5B is the same as FIG. 5A, but illustrating the cam follower at an intermediate position.
FIG. 5C is the same as FIGS. 5A, 5B, but with the cam follower at a second extreme position.

Cam assembly 196, which may be a Ferguson Drive, comprises an arrangement capable of transmitting the rotary motion of input shaft 202 to oscillatory or reciprocative motion. An example of such an arrangement is illustrated in FIGS. 5A, 5B and 5C wherein input shaft 202 has cylindrically- shaped ring 208 secured thereto and which ring 208 has a cam 210 with a cam surface 212 selectively disposed thereon. Engaged with cam 210 is a yoke-type cam follower 214 having legs 216 extending outwardly therefrom with rollers 218 rotatably connected thereto, respectively. Legs 216 are angled so that rollers 218 are engaged with cam surface 212. It can be seen in FIGS. 5A, 5B and 5C that cam surface 212 tapers outwardly from the periphery of cam 210 to ring 208 so that smooth, uninterrupted oscillatory motion is transferred to cam follower 214. Cam follower 214 further has hole 220 disposed therein for securely receiving therein spindle 222 of operating shaft 168, spindle 222 being secured thereto so that operating shaft 168 is oscillated by cam follower 214. This particular cam arrangement is a commercially available device and may be procured from Ferguson Machine Company.

The following description of the operation of cam actuated ejector 20 involves only two ejector bars 112, 113 ejecting only two shells 44, however, only one ejector bar 112 or a plurality of ejector bars 112, 113 may be provided depending upon the number of shells 44 simultaneously formed from strip stock 22. Upon actuation of shell press 10, the strip stock feeder supplies strip stock 22 along tin line 36 to blanking and forming punch assembly 12. As described above, punch 32 and upper forming die 72 then move downwardly under the drive of press crankshaft 80 to blank and form shell 44. Punch 32 initially contacts strip stock 22 to cut a blank circular disc from the strip stock and thereafter upper forming die 72 forms the blank circular disc into the shape illustrated in FIG. 4. Thereafter, upper forming die 72 and punch 32 proceed upwardly under the drive of crankshaft 80 with upper forming die 72 initially withdrawing from contact with shell 44 and punch 32 thereafter. Lift-out element 46 then lifts the completed shell as illustrated again in FIG. 4. Just prior to punch 32 moving upwardly and out of contact with shell 44, cam assembly 196 accelerates ejector bars 112, 113 from their first positions out of the blanking and forming punch assembly 12 area to points adjacent punch 32 as illustrated in FIG. 1A. FIGS. 5A and 5B illustrate the position of cam follower 214 relative to cam 210 when the ejector bars 112, 113 are in their first and intermediate positions, respectively. As ring 208 rotates with input shaft 202, cam 210 likewise rotates from the position in FIG. 5A to that in FIG. 5B, thereby causing cam follower 214 to move in a direction right to left. Since operating shaft 168 is connected to cam follower 214 by spindle 222, operating shaft 168 is likewise rotated to move operating arms 186, 188, which in turn move ejector bars 113, 112 left to right in FIGS. 1A, 3. Further rotation of ring 208 by input shaft 202 places cam follower 214 in the position illustrated in FIG. 5C, which movement is again transferred through operating shaft 168 and operating arm 186, 188 to ejector bars 113, 112, respectively. The movement of cam follower 214 from its position illustrated in FIG. 5A to its position illustrated in FIG. 5C moves operating arms 186, 188 from their positions illustrated in FIG. 1A to the dotted line positions also illustrated in FIG. 1A, thereby reciprocating ejector bars 113, 112 from their solid line positions in FIGS. 1A and 3 to their dotted line positions illustrated in the same figures. It is noteworthy in FIG. 3 that each ejector bars 113, 112 have an identical stroke length, which eliminates one ejector bar from residing in the blanking and forming punch assembly 12 longer than another ejector bar. Equal stroke lengths allow shell press 10 to operate more quickly. Furthermore, since ejector bars 113, 112 are coplanar with each other and with their respective shells 44, their assembly within lower die assembly 136 may be made in a compact, space-saving manner.

The positive drive control of ejector bars 113, 112 by cam assembly 196 is very unique to the operation performed by shell press 10. By selectively contouring cam surface 212, the oscillating movement of cam follower 214, and consequently the reciprocating motion of ejector bars 113, 112, may be made to vary the rates and timings of movement of ejector bars 113, 112. Cam actuated ejector 20 provides a cam surface 212 that will more slowly accelerate ejector bars 113, 112 to an intermediate position wherein the ends 224, 226 of ejector bars 113, 112, respectively, contact their respective shells 44 so as not to deform the shells by sudden impact. Thereafter, cam surface 212 will cause ejector bars 113, 112 to be rapidly accelerated to their dotted line positions to eject shells 44 upwardly along incline 114 to air conveyor assembly 14. Thereafter, cam surface 212 will rapidly retract ejector bars 113, 112 to their solid line positions to minimize their residence time within punch assembly 12, thereby enabling the press to run at higher speeds. Furthermore, such positive control of ejector bars 113, 112 from their solid line to their dotted line positions and from their dotted line to their solid line positions eliminates any problems associated with spring-actuated ejector bars.

Although cam assembly 196 has been described above with a particular cam 210 with cam surface 212 and cam follower 214, other such arrangements capable of transforming rotary motion into oscillatory or reciprocative motion is known in the art. Furthermore, the operative connection between operating shaft 168 and ejector bars 152, 154 by operating arms 186, 188, respectively, in slots 156, respectively, may also be varied to provide similar reciprocative motion of ejector bars 113, 112.

Figure 6:
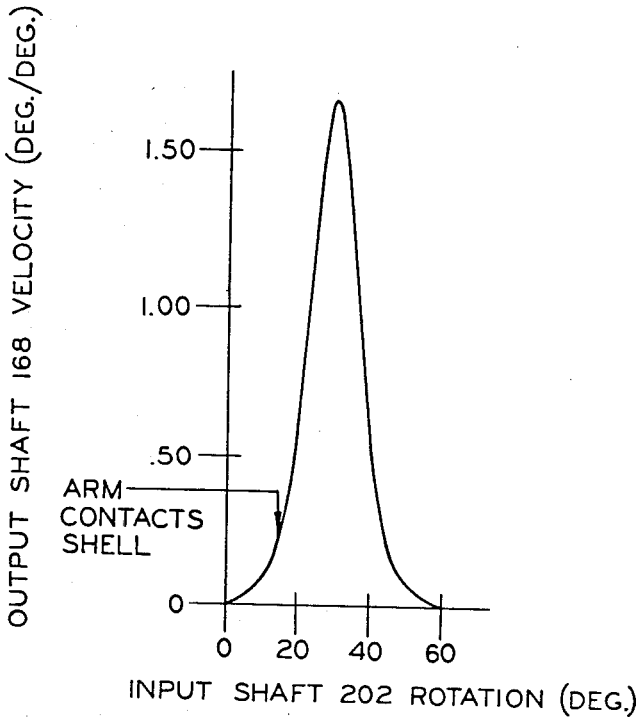
FIG. 6 is a graph plotting the cyclically time-dependent positions of the ejector arms relative to the press rotation.

Intuitively clear from the above description and operation of shell press 10 and cam actuated ejector 20 of the present invention is the importance of timing throughout the blanking and forming process. FIG. 6 illustrates the positions of ejector bar ends 224, 226 during one cycle of shell press 10. Such precise time-dependent positioning of ejector bar ends 224, 226 is possible by forming cam surface 212 of cam 210 with a predetermined contour to desirably position ends 224, 226 in synchronism with assembly of shell press 10. As can be seen, ejector bars 112 and 113 contact shells 44 at approximately 15° at a relatively low velocity and then accelerate shells 44 up to the peak velocity. A preferred contact range for ejectors 112 and 113 is between 12° and 20° of input shaft 202.

While this invention has been described in terms of a specific embodiment, it will be understood that it is capable of further modification. This application is therefore intended to cover any variations, uses or adaptations of the invention following the general principles thereof, and including such departures from the present disclosure as come within known or customary practice in the art to which this invention pertains and fall within the limits of the appended claims.

What is claimed is:

1. In a shell press having a crankshaft for reciprocating a slide adapted for having tooling mounted thereto and a forming station in which said tooling forms a shell, a shell ejector apparatus for ejecting formed shells comprising:

means for lifting a formed shell to a selected plane, an ejector member having an end portion and being reciprocable in said plane, and means constantly synchronized with said slide for positively driving said ejector member in said selected plane from a first position in said selected plane wherein said end portion is disposed out of said forming station and spacing from a position in the work station in which a shell to be ejected is normally supported to a second position in said selected plane wherein said end portion is disposed in said forming station in a space normally occupied by a formed shell to be ejected and from the second position back to the first position.

2. The shell press of claim 1 wherein said positive driving means moves said ejector member end portion at a controlled velocity from the first position to an intermediate position in said selected plane normally occupied by an edge of a shell to be ejected from said forming station, said positive drivng means then accelerating said ejector member end portion from the intermediate position to the second position to thereby eject a shell from said forming station, said positive driving means then withdrawing said ejector member end portion from the second position to the first position.

3. The shell press of claim 2 wherein said positive driving means includes a cam element having a contoured cam surface and a cam follower member in engagement with said cam surface, one of said cam elements and said cam follower member being operatively connected to said ejector member, and further including means synchronized with said slide for moving the other of said cam element and said cam follower member to cause relative movement between said cam surface and said cam follower member to rectilinearly move said ejector member between the first and second positions in said selected plane.

4. The shell press of claim 3 wherein said cam surface provides different rates of movement to said ejector member.

5. The shell press of claim 3 wherein said cam follower member is operatively connected to said ejector member and said cam element is operatively connected to said synchronized moving means.

6. The shell press of claim 5 further including actuating members engaged between said cam follower member and said ejector member, said actuating members including a shaft connected to said cam follower member to be moved thereby, and a lever member radially disposed from said shaft to be moved thereby and engaged with said ejector member to move said ejector member between the first and second positions.

7. The shell press of claim 3 wherein said synchronized moving means includes a first sprocket member secured to said crankshaft, said cam element being operatively connected to a second sprocket member and a continuous link member coupled with said sprockets to provide synchronous engagement between said shell press crankshaft and said cam element.

8. The shell press of claim 6 wherein said ejector member has a slot therein and said lever member has its remote end portion received in said slot to link said lever member to said ejector member.

9. The shell press of claim 8 further including a plurality of ejector members engaged by a respective plurality of lever members connected to said shaft to rectilinearly move said ejector members between respective first and second positions.

10. The shell press of claim 1 further including fluid means for conveying ejected shells to subsequent shell press stations.

* * * * *

UNITED STATES PATENT AND TRADEMARK OFFICE

CERTIFICATE OF CORRECTION

PATENT NO. : 4,627,264

DATED : December 9, 1986

INVENTOR(S) : Arthur L. Grow et al

It is certified that error appears in the above—identified patent and that said Letters Patent is hereby corrected as shown below:

In the title, delete the present title and insert therefor --SHELL PRESS CAM ACTUATED EJECTOR--.
Claim 1, Col. 8, line 62, change "spacing" to --spaced--.
Claim 2, Col. 9, line 7, change "drivng" to --driving--.

Signed and Sealed this

Twenty-fourth Day of March, 1987

*Attest:*

DONALD J. QUIGG

*Attesting Officer* *Commissioner of Patents and Trademarks*